US006793085B1

(12) United States Patent
Russo

(10) Patent No.: US 6,793,085 B1
(45) Date of Patent: Sep. 21, 2004

(54) HIGH-STABILITY COMPOSABLE CASE

(75) Inventor: Gerlando Russo, Busto Arsizio Varese (IT)

(73) Assignee: Costruzioni Meccaniche Luigi Bandera S.p.A., Busto Arsizio-Varese (IT)

( * ) Notice: Subject to any disclaimer, the term of this patent is extended or adjusted under 35 U.S.C. 154(b) by 111 days.

(21) Appl. No.: 10/257,854

(22) PCT Filed: Jun. 21, 2000

(86) PCT No.: PCT/EP00/06987

§ 371 (c)(1),
(2), (4) Date: Oct. 17, 2002

(87) PCT Pub. No.: WO01/94214

PCT Pub. Date: Dec. 13, 2001

(30) Foreign Application Priority Data

Jun. 2, 2000 (IT) ..... MI20000341 U

(51) Int. Cl.[7] ..... B65D 6/12
(52) U.S. Cl. ..... 220/7
(58) Field of Search ..... 220/7, 6

(56) References Cited

U.S. PATENT DOCUMENTS 4,005,795 A * 2/1977 Mikkelsen et al. ..... 220/7
5,279,438 A * 1/1994 Cesano ..... 220/7
5,452,817 A * 9/1995 Taravella et al. ..... 220/4.33
6,015,056 A * 1/2000 Overholt et al. ..... 220/6
6,155,444 A * 12/2000 Liu ..... 220/7

FOREIGN PATENT DOCUMENTS

| | | |
|---|---|---|
| DE | 41 37 095 | 5/1993 |
| EP | 0 522 654 A | 1/1993 |
| EP | 0 990 589 | 4/2000 |

* cited by examiner

*Primary Examiner*—Joseph Man-Fu Moy
(74) *Attorney, Agent, or Firm*—Hedman & Costigan, P.C.

(57) ABSTRACT

A high-stability composable case of the type comprising a thermoformed element made of plastic material consisting of a central panel (12) having a quadrilateral shape, the sides of which are connected, by means of fold-inviting lines (17, 18), to four sides of side panels (13, 14, 15, 16), which may be folded, in a box-like manner, on the central panel (12), there being provided corner elements for forming and blocking (25) between the central panel and the side panels, where the side panels are equipped with flap-like edges (20, 21) which protrude outwards with respect to the side panels (13, 14, 15, 16) and which can be set alongside one another in a closed box-like position of the case to be inserted two by two within a slit (37) of each corner element for forming and blocking (25), in which the flap-like edges (20, 21) provide longitudinal and transverse elements for engagement and connection (23, 27; 29, 30; 31, 32) designed to bring about a stable reciprocal positioning between the flap-like edges (20, 21).

8 Claims, 4 Drawing Sheets

25
36
36
38
37
38
24
20
23
22
30
28
27
29
31
26
21

HIGH-STABILITY COMPOSABLE CASE

The present invention refers to a high-stability composable case, in particular with corner elements for forming and blocking.

At present, in the field of packaging of fruit and vegetable produce, cases (crates and boxes) made of various materials, such as wood or plastic, variously formed, shaped or moulded, are used as means for containing the said produce. Although these cases are quite strong and economical, they present a number of problems as regards their formation, transportation when empty, and their possible recovery.

These problems arise in particular when the gathering of fruit or vegetables takes place in one region, and transportation or use in a different region at some distance from the former region. In fact, it is necessary to envisage costs for the formation of the case, its transportation, and its destruction or recovery.

Precisely in an attempt to overcome all the above-mentioned problems, thermoformed cases have been proposed, made from sheets of plastic material, which can be put together, assembled, and blocked in the assembled condition by means of pin-type elements that can be inserted into special holes made in parts of the case itself, as thermoformed.

In addition, cases made of plastic material have been proposed which can also be assembled with corner elements for forming and blocking, and which, although they can be assembled rapidly, do not present satisfactory conditions of stable maintenance of the structure once the case is mounted and formed.

A purpose of the present invention is to overcome the aforementioned problems and drawbacks by providing a composable case, mainly made by moulding or thermoforming of plastic material, which, whilst presenting considerable simplicity of construction and assembly, satisfies the requirements referred to above.

Another purpose of the present invention is to provide a type of case which is economical and which may possibly be easily disassembled into component parts that are not bulky, at the same time as presenting a considerable stability once assembled.

These and other purposes according to the present invention are achieved by providing a high-stability composable case, in particular with corner elements for forming and blocking according to what is specified in claim 1.

The structural and functional characteristics, as well as the advantages, of a composable case according to the present invention will emerge more clearly evident from the ensuing description of an embodiment thereof, which is provided purely to furnish an explanatory and non-limiting example, with reference to the attached schematic drawings in which.

Figure 1:
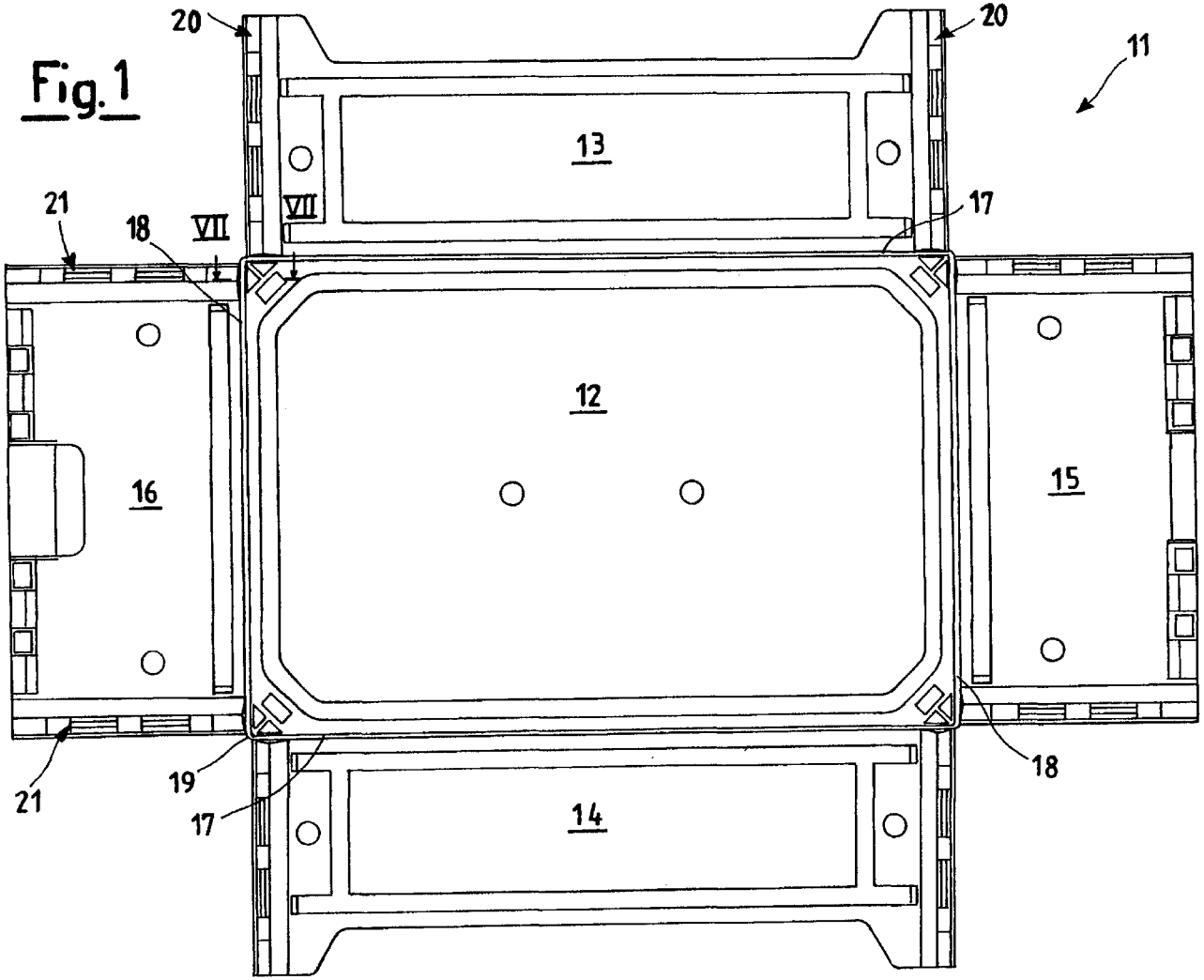
FIG. 1 is a top plan view of a composable case according to the present invention, laid out flat in its full development.
Figure 2:
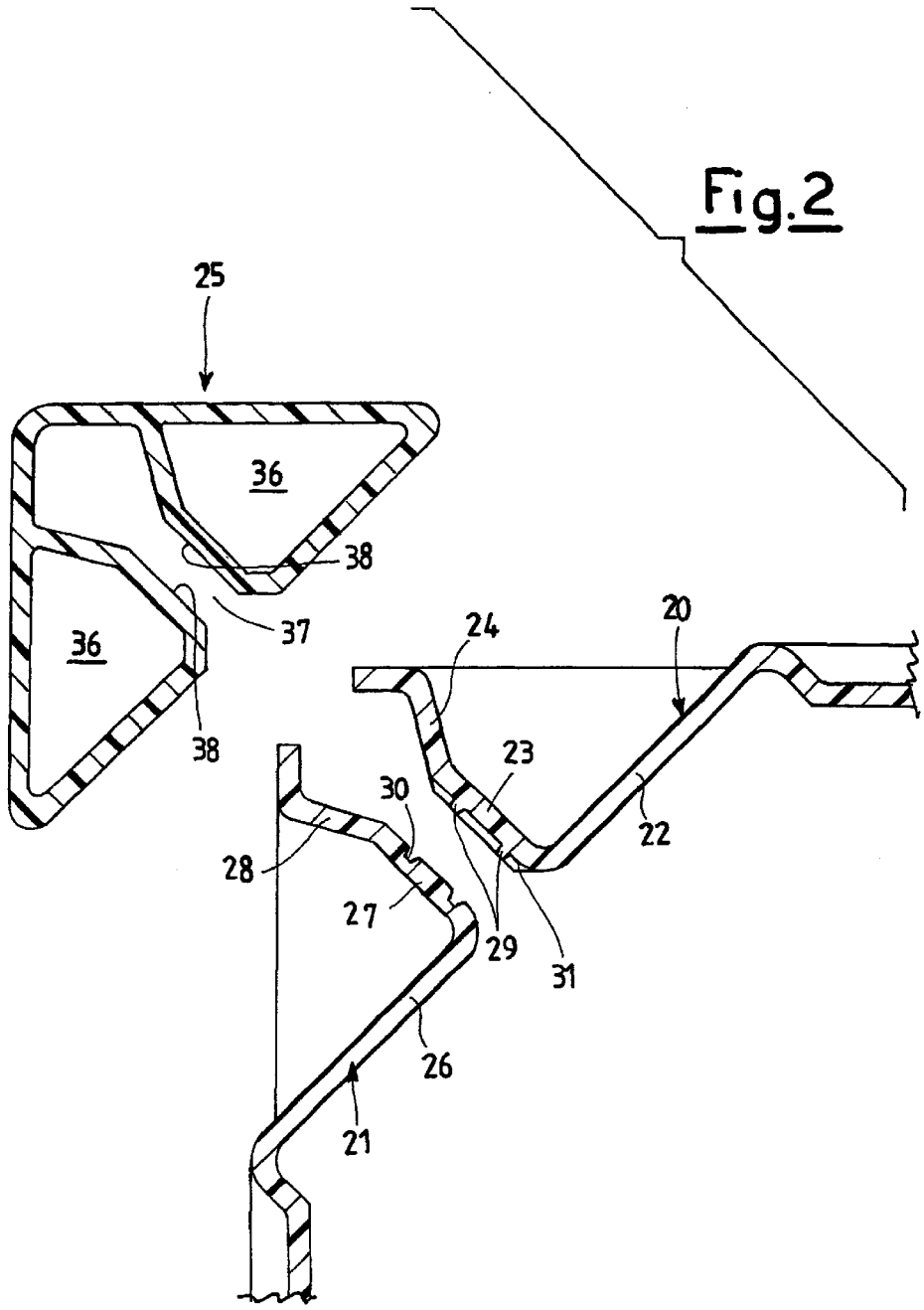
FIG. 2 is an exploded sectional view of a corner element for forming and blocking for two panel flaps of the case of FIG. 1.

With reference first to FIG. 1, a thermoformed element made of a sheet of plastic material, designated as a whole by 11 and basically made up of a number of flat panel-type parts variously shaped and articulated together, is shown.

The thermoformed element 11 is, for example, made of polyolefin-based plastic material, or else plastic material made using organic or inorganic extenders. The thermoformed element 11 constitutes a plane development of a composable case and comprises a central panel 12 having a quadrilateral shape—in the example illustrated, rectangular—and four side panels 13, 14 and 15, 16, set opposite two by two and complementary to each other.

Connection between the central panel 12 and the side panels 13, 14, 15 and 16 takes place according to fold-inviting lines 17 and 18, these also being made during thermoforming.

The four side panels 13, 14, 15 and 16 may be folded in a box-like manner with respect to the central panel 12, and are provided, along the sides, which extend from the corners 19 of the central panel 12, with flap-like edges 20 and 21 projecting outwards with respect to the side panels 13, 14, 15 and 16. More precisely, for example, the side panel 13 is provided with two flap-like edges 20 which are equal to one another and which project from its opposite sides.

Each flap-like edge 20 presents a shape which, starting in section from the side panel 13 itself, comprises a first, smooth, area 22, a second area 23 provided with male parts, and a third, folded, area 24 which can be stably positioned within a corner element for forming and blocking, the latter element being designated, as a whole, by 25.

Likewise, each flap-like edge 21, for instance set on opposite sides on the panel 16, also presents a shape which, starting in section from the side panel 16 itself, comprises a first, smooth, area 26, a second area 27 provided with female parts, and a third, folded, area 28 which can be stably positioned within a corner element for forming and blocking 25. In this way, elements of engagement and connection are obtained, which are naturally complementary to the ones made in the previous flap-like edge 20.

The second areas 23 and 27, in fact, present elements for engagement and connection made in portions provided with longitudinal ribs 29 and, respectively, portions provided with longitudinal grooves 30 designed to receive the ribs 29. In addition, also provided on one side are portions having transverse projections 31, and on the other side, portions having transverse housings 32 designed to receive the projections 31. In this way a constraint is formed between the two flap-like edges 20 and 21 thanks to the fact that there engage together, on the one hand, the longitudinal ribs 29 and the longitudinal grooves 30, and, on the other, the transverse projections 31 and the transverse housings 32. A co-operation of this sort guarantees stability in all directions for the two flap-like edges 20 and 21 contained in the corner element for forming and blocking 25.

The same may be said for the remaining corners and edges of the case, once the panels 13, 14, 15 and 16 have been raised into a position perpendicular to the central panel 12 in order to form the case.

It should also be noted that, at each corner 19, on the internal part of the central panel 12, on each case formed there are provided elements of stabilization when the case is structurally assembled.

Figure 3:
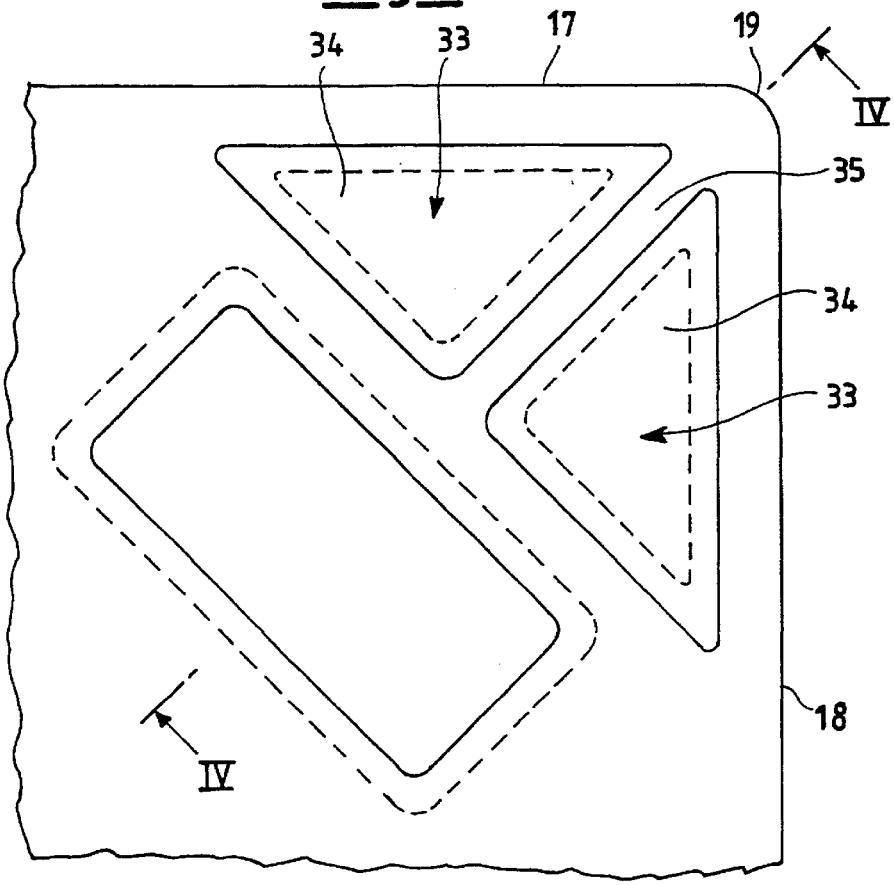
FIG. 3 is a plan view at an enlarged scale of a detail in a corner position of the case.
Figure 4:
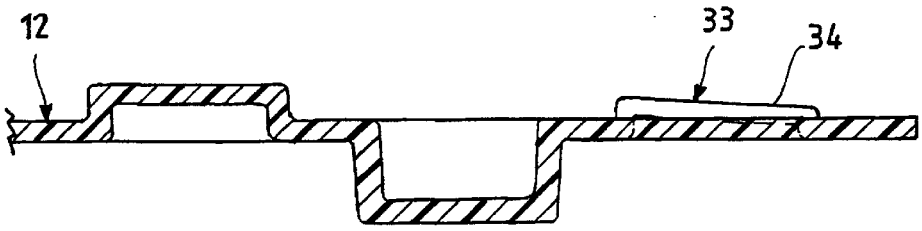
FIG. 4 is a sectional view according to the trace IV-IV of the detail shown in FIG. 3.
Figure 7:
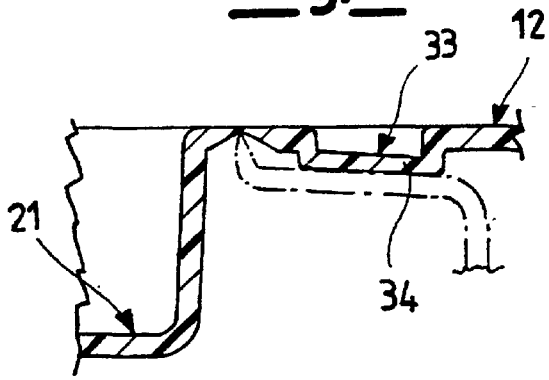
FIG. 7 is an enlarged sectional view according to the trace VII-VII of FIG. 1.
Figure 5:
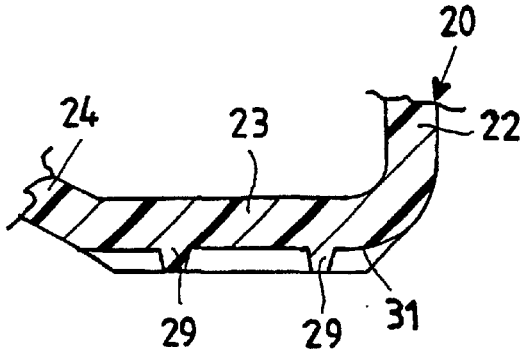
FIG. 5 is an enlarged sectional view of a detail of FIG. 2.
Figure 6:
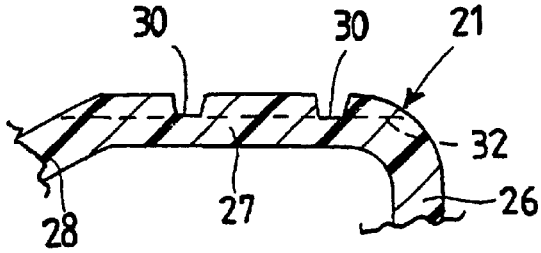
FIG. 6 is an enlarged sectional view of a detail of FIG. 2.

In fact, as shown in FIG. 1, and more clearly still in FIG. 3, two projecting teeth 33 are made with top surfaces 34 inclined towards the outside of the central panel 12. The two projecting teeth 33 are shaped like an equilateral triangle and are brought up together along one of their sides set facing to define a channel 35. Co-operation of the said teeth 33 with a bottom internal surface of the flap-like edges 20 and 21 determines a considerable stability of the case thus formed and a greater resistance to the weight of the contents.

In this way, also possible is a co-operation of the teeth 33 with a pair of hollow tubular portions 36 made in the corner element for forming and blocking 25, which determines an engagement between the parts of a formed case.

In addition, there is provided, in co-operation with said teeth 33 projecting upwards, a hollow 36, for example made facing inwards and having a rectangular shape, designed to receive a surface facing in the opposite direction in a further thermoformed element 11 when still in plane development.

This arrangement makes it possible to minimize the space occupied by thermoformed elements 11 stacked on top of one another with minimum encumbrance, at the same time stabilizing the stack of thermoformed elements.

It has already been said how important it is that, in the position where the side panels 13 and 15, 15 and 14, 14 and 16, and finally 16 and 13, are folded and brought up together, it should be possible to proceed to a fast and stable fixing between the panels with the corner elements for forming and blocking 25. In addition, since these corner elements for forming and blocking 25 are provided with closed tubular hollow portions 36, a great stability is achieved also of the corner elements for forming and blocking 25, with greater stability of the entire case.

It should also be borne in mind that each of the corner elements for forming and blocking 25 constitutes a column which has, at the centre, a vertical slit 37 identified by two shaped vertical walls 38 external to the tubular hollowed portions 36.

A case of this sort is particularly suited for containing fruit and other similar produce so as to protect it in an appropriate way.

It is evident that said panels 12–16 may have ribbings, material removed, such as undercuts, for lightening the structure, various holes, which individually strengthen the panels, as well as making them lighter. In addition, the cut-away parts for lightening the structure enable an immediate recovery of part of the material, which is immediately reintroduced into the production cycle and used to form other cases, with a maximum and optimal exploitation of all the material.

A composable case according to the present invention may be assembled in an extremely fast way, starting from its flattened-out condition for transportation and storage, by simply inserting the flaps 23, 24, and 27, 28 into the slits 37 of four columns 25.

Once it has been used for containing and transporting produce, the case can then be disassembled again into its flat component and into its corner-constraining elements, for great convenience of transportation. An advantage is in fact obtained in so far as the elements can be stacked in contained spaces, with minimum encumbrance.

Alternatively and advantageously, when it is no longer intended to re-use the said case, it is possible to do without using the corner-constraining columns and to bring together the corner flap-like edges and join them by fastening them together using suitable fixing means, such as welding.

What is claimed is:

1. A high-stability composable case of the type comprising a thermoformed element made of plastic material consisting of a central panel (12) having a quadrilateral shape, the sides of which are connected, by means of fold-inviting lines (17, 18), to four sides of side panels (13, 14, 15, 16), which may be folded, in a box-like manner, on said central panel (12), there being provided corner elements for forming and blocking (25) between said central panel and said side panels, where said side panels are equipped with flap-like edges (20, 21) which protrude outwards with respect to the side panels (13, 14, 15, 16) and which can be set alongside one another in a closed box-like position of said case to be inserted two by two within a slit (37) of each corner element for forming and blocking (25), said composable case being characterized in that said flap-like edges (20, 21) provide longitudinal and transverse elements for engagement and connection (23, 27; 29, 30; 31, 32) designed to bring about a stable reciprocal positioning between said flap-like edges (20, 21).

2. A composable case according to claim 1, characterized in that said longitudinal elements for engagement and connection on said flap-like edges comprise, on one side, longitudinal ribs (29) and, on the other side, longitudinal grooves (30) designed to receive said ribs (29).

3. A composable case according to claim 1, characterized in that said transverse elements for engagement and connection on said flap-like edges comprise, on one side, transverse projections (31) and, on the other side, transverse housings (32) designed to receive said projections (31).

4. A composable case according to claim 1, characterized in that said central panel (12) is provided at each corner (19), in its internal part, with elements for stabilization (33) during structural assembly of said case.

5. A composable case according to claim 4, characterized in that said stabilization elements are made up of at least two protruding teeth (33) with their top surfaces (34) inclined towards the outside of said central panel (12).

6. A composable case according to claim 5, characterized in that said two protruding teeth (33) are shaped like an equilateral triangle and are brought up together along one of their sides set facing to define a channel (35) between them.

7. A composable case according to claim 1, characterized in that each corner element for forming and blocking (25) comprises a pair of hollow tubular portions (36) set at a distance apart to identify a vertical slit (37) defined by two vertical walls (38).

8. A composable case according to claim 1, characterized in that said hollow tubular portions (36) set at a distance apart are closed.

* * * * *